US009422749B2

(12) United States Patent
Lu

(10) Patent No.: US 9,422,749 B2
(45) Date of Patent: Aug. 23, 2016

(54) ANTI-OFF STRUCTURE OF TOOL BOX

(71) Applicant: CASEMATE PLASTICS INDUSTRIES CO., LTD., Taichung (TW)

(72) Inventor: Jen-Chiang Lu, Taichung (TW)

(73) Assignee: CASEMATE PLASTICS INDUSTRIES CO., LTD., Taichung (TW)

( * ) Notice: Subject to any disclaimer, the term of this patent is extended or adjusted under 35 U.S.C. 154(b) by 0 days.

(21) Appl. No.: 14/690,825

(22) Filed: Apr. 20, 2015

(65) Prior Publication Data

US 2016/0145905 A1 May 26, 2016

(30) Foreign Application Priority Data

Nov. 25, 2014 (TW) ..... 103220875

(51) Int. Cl.
*E05B 3/00* (2006.01)
*E05B 65/00* (2006.01)
*B25H 3/02* (2006.01)

(52) U.S. Cl.
CPC ..... *E05B 65/006* (2013.01); *B25H 3/02* (2013.01)

(58) Field of Classification Search
CPC ..... Y10S 292/49; Y10T 292/49
USPC ..... 292/256.69, 23
See application file for complete search history.

(56) References Cited

U.S. PATENT DOCUMENTS

| | | | | | |
|---|---|---|---|---|---|
| 4,917,421 | A * | 4/1990 | Wightman | E05C 19/14 | 292/247 |
| 4,920,771 | A * | 5/1990 | Jiang | E05B 37/02 | 70/312 |
| 5,127,684 | A * | 7/1992 | Klotz | E05C 19/14 | 292/113 |
| 5,193,706 | A * | 3/1993 | Hanna | B25H 3/02 | 220/315 |
| 5,472,110 | A * | 12/1995 | Boyd | A45C 13/02 | 206/373 |
| 5,762,411 | A * | 6/1998 | Yemini | B25H 3/003 | 206/372 |
| 6,179,350 | B1 * | 1/2001 | Ely | E05C 19/14 | 292/113 |
| 6,955,381 | B2 * | 10/2005 | Parker | A45C 13/1084 | 292/113 |
| 7,568,739 | B2 * | 8/2009 | Lee | B25H 3/02 | 220/324 |
| 8,602,256 | B2 * | 12/2013 | Wang | B25H 3/02 | 220/326 |
| 2013/0127183 | A1 * | 5/2013 | Chang | B25H 3/02 | 292/202 |

* cited by examiner

*Primary Examiner* — Matthew Ing
(74) *Attorney, Agent, or Firm* — Muncy, Geissler, Olds & Lowe, P.C.

(57) ABSTRACT

An anti-off structure of a tool box is provided. The tool box includes a first cover and a second cover pivoted with and correspondingly coverable on each other on a side thereof. The first cover has a pivoting base, and the second cover has a clasping base. The anti-off structure includes an engaging member and a positioning member. The engaging member includes an engaging portion, and an end thereof is pivoted to the pivoting base via a pivoting connection mechanism; therefore, the engaging portion is buckleable with the clasping base when the first and second covers cover on each other. The positioning member is connected with the pivoting connection mechanism and the pivoting base to positionably restrict the pivoting connection mechanism.

7 Claims, 8 Drawing Sheets

ANTI-OFF STRUCTURE OF TOOL BOX

BACKGROUND OF THE INVENTION

1. Field of the Invention

The present invention relates to a tool box, and more particularly to an anti-off structure of a tool box.

2. Description of the Prior Art

Usually, in order to allow two covers to be engaged with each other, a tool box is often assembled with engaging members. However, this type of engaging members need to be replaced due to abrasion; therefore, an anti-off structure as shown in FIG. 9 is disclosed. The anti-off structure takes advantage of an opening end which is smaller than a pivoting rod of the engaging member in diameter to allow the engaging member to be engaged on a pivoting base.

However, the engaging member in this type of tool box falls off easily from the pivoting base when the tool box is opened or turned over. In addition, the engaging member falls off easily because the opening end is easily abraded after the engaging member of the pivoting base is replaced many times. Furthermore, when the engaging member needs to be assembled on the pivoting base, an amount of force is needed to make the engaging member engaged on the pivoting base.

The present invention has arisen to mitigate and/or obviate the afore-described disadvantages.

SUMMARY OF THE INVENTION

The major object of the present invention is to provide an anti-off structure of a tool box. An engaging member has a positioning member to prevent the engaging member from falling off from the tool box, and an opening end of a pivoting base does not need to be smaller than a pivoting rod in diameter to be positioned on the pivoting base; therefore, the pivoting base is not easily abraded due to replacement of the engaging member. Via the anti-off structure, it is more effort-saving for a user to assemble the engaging member on the pivoting base.

To achieve the above and other objects, an anti-off structure of a tool box is provided. The tool box includes a first cover and a second cover pivoted with and correspondingly coverable on each other on a side thereof. The first cover has a pivoting base, and the second cover has a clasping base. The anti-off structure includes an engaging member and a positioning member. The engaging member includes an engaging portion, and an end thereof is pivoted to the pivoting base via a pivoting connection mechanism. The engaging portion is buckleable with the clasping base when the first and second covers cover on each other. The positioning member is connected with the pivoting connection mechanism and the pivoting base to positionably restrict the pivoting connection mechanism.

The present invention will become more obvious from the following description when taken in connection with the accompanying drawings, which show, for purpose of illustrations only, the preferred embodiment(s) in accordance with the present invention.

DETAILED DESCRIPTION OF THE PREFERRED EMBODIMENTS

Figure 1:
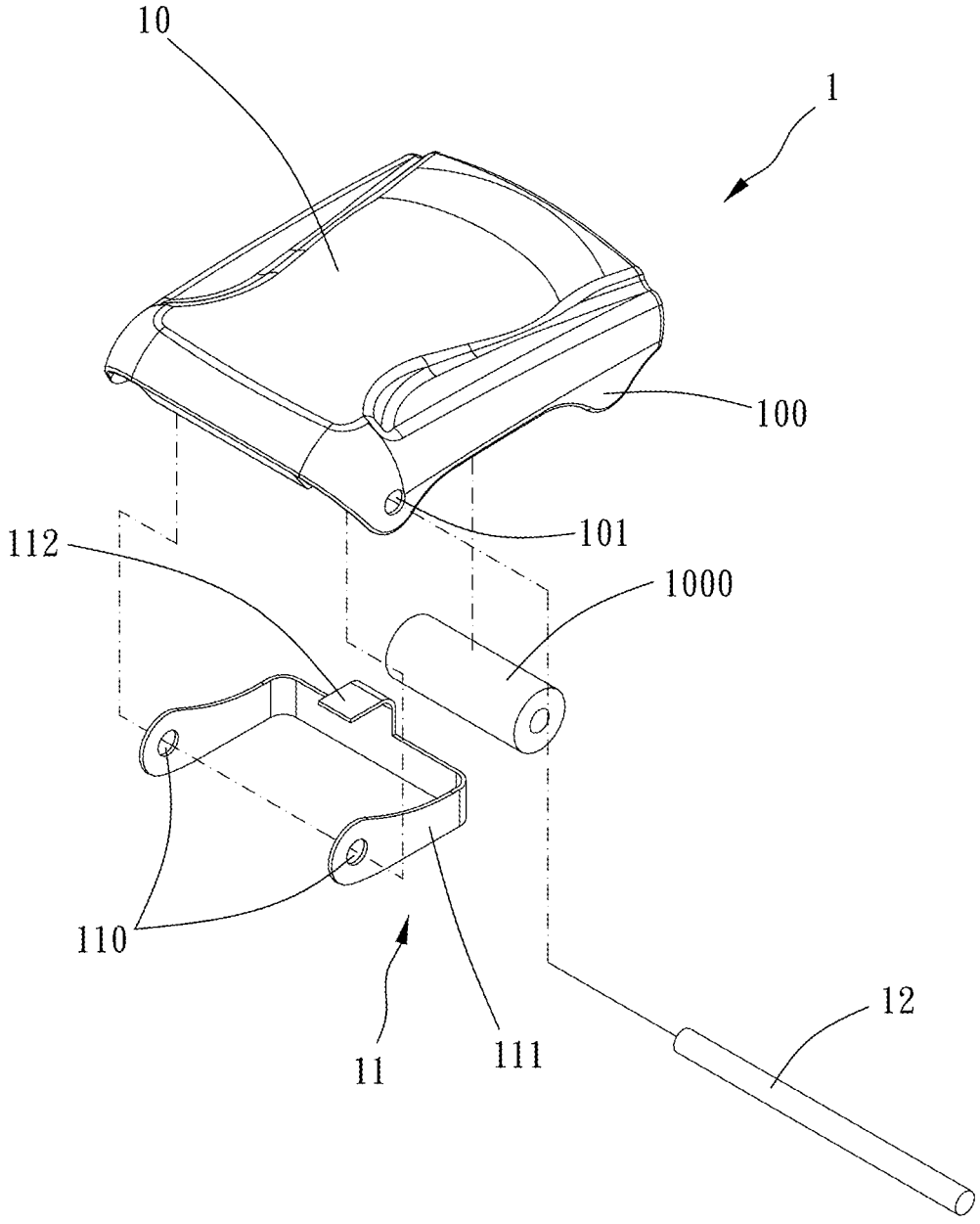
FIG. 1 is a breakdown drawing of a preferred embodiment of the present invention.
Figure 2:
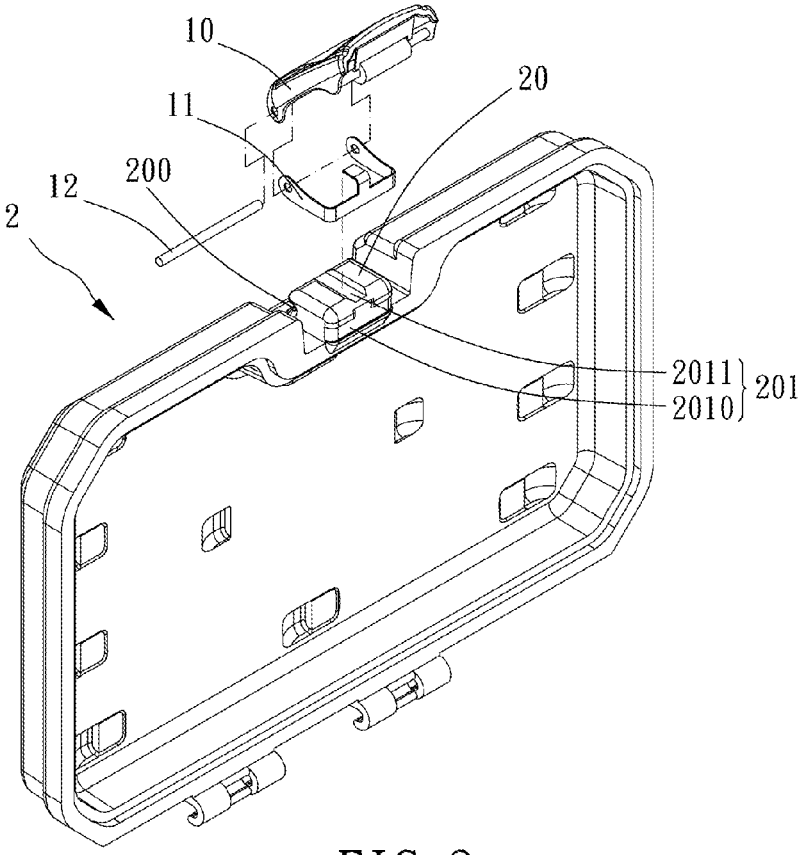
FIG. 2 is a breakdown drawing of an anti-off structure and a first cover of the present invention.

The present invention will be clearer from the following description when viewed together with the accompanying drawings, which show, for purpose of illustrations only, the preferred embodiment in accordance with the present invention.

Please refer to FIGS. 1 to 8 for a preferred embodiment of an anti-off structure 1 of a tool box of the present invention. The tool box includes a first cover 2 and a second cover 3 pivoted with and correspondingly coverable on each other on a side thereof. The first cover 2 has a pivoting base 20, and the second cover 3 has a clasping base 30. The anti-off structure 1 includes an engaging member 10 and a positioning member 11.

The engaging member 10 includes an engaging portion 100, and an end thereof is pivoted to the pivoting base 20 via a pivoting connection mechanism 4. The engaging portion 100 is buckleable with the clasping base 30 when the first cover 2 and the second cover 3 cover on each other. In this embodiment, the pivoting connection mechanism 4 includes a first pivoting connection portion 101 provided on the engaging member 10, a second pivoting connection portion 110 provided on the positioning member 11, a pivoted portion 200 provided on the pivoting base 20 and a pivoting rod 12. Specifically, at least one of the first pivoting connection portion 101 and the second pivoting connection portion 110 is a through hole. More specifically, in this embodiment, both the first pivoting connection portion 101 and the second pivoting connection portion 110 are through holes so that the pivoting rod 12 is pivoted to the first pivoting connection portion 101, the second pivoting connection portion 110 and the pivoted portion 200 and that the engaging member 10 and the positioning member 11 are assembled on the pivoting base 20. Specifically, the pivoting rod 12 is movably engaged with the pivoted portion 200, so the pivoting rod 12 is detachably pivoted to the pivoted portion 200. It is to be noted that the first and second pivoting connection portions 101, 110 and the pivoted portion 200 may be designed to have such a combination which the first and second pivoting connection portions 101, 110 and the pivoted portion 200 are pivoted with and connected with one another.

The positioning member 11 is connected with the pivoting connection mechanism 4 and the pivoting base 20 to positionably restrict the pivoting connection mechanism 4. Specifically, the pivoting base 20 has a positioning slot 201 for the positioning member 11 to be restrictedly disposed therein, the positioning slot 201 includes a circumferential slot portion 2010 and a top slot portion 2011, the positioning member 11 includes a C-shaped main body 111 and an L-shaped toggling portion 112, the C-shaped main body 111 is restrictedly disposed in the circumferential slot portion 2010, and the toggling portion 112 extends from the C-shaped main body to be restrictedly disposed in the top slot portion 2011. When the engaging member 10 is opened, the engaging member 10 produces a force to fall off downwardly from the pivoted portion 200. The positioning member 11 is restrictedly disposed in the circumferential slot portion 2010 to prevent the engaging member 10 from falling off. When a user wants to disassemble the engaging member 10 from the pivoting base 20, s/he only needs to apply force on the toggling portion 112. Then, the positioning member 11 is released from the positioning slot 201 for replacing the engaging member 10. It is to be noted that there may be none positioning slot, and the positioning member 11 may be assembled to the pivoting base 20 via other structures; for example, a clasping mechanism may be used to allow the positioning member 11 to be assembled to the pivoting base 20.

Figure 4:
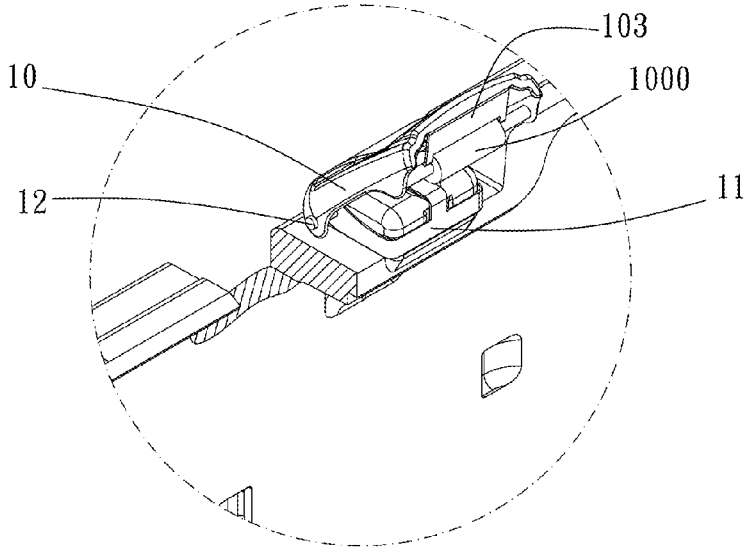
FIG. 4 is a drawing showing the preferred embodiment of the present invention in use.
Figure 3:
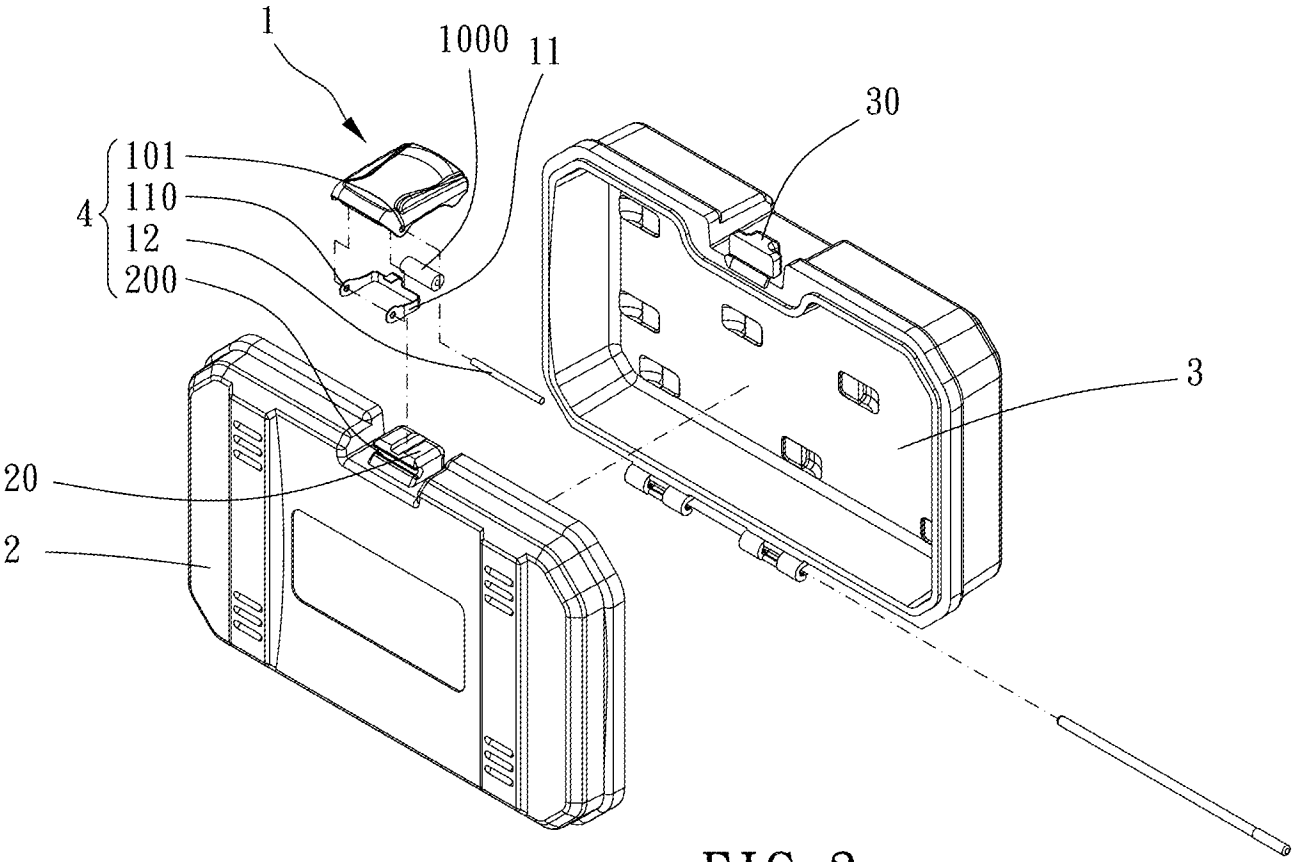
FIG. 3 is a breakdown drawing of the anti-off structure and a tool box of the present invention.
Figure 9:
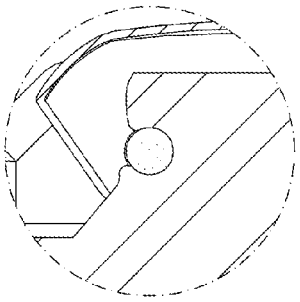
FIG. 9 PRIOR ART
FIG. 9 is a partial cross-sectional drawing of a conventional tool box.
Figure 5:
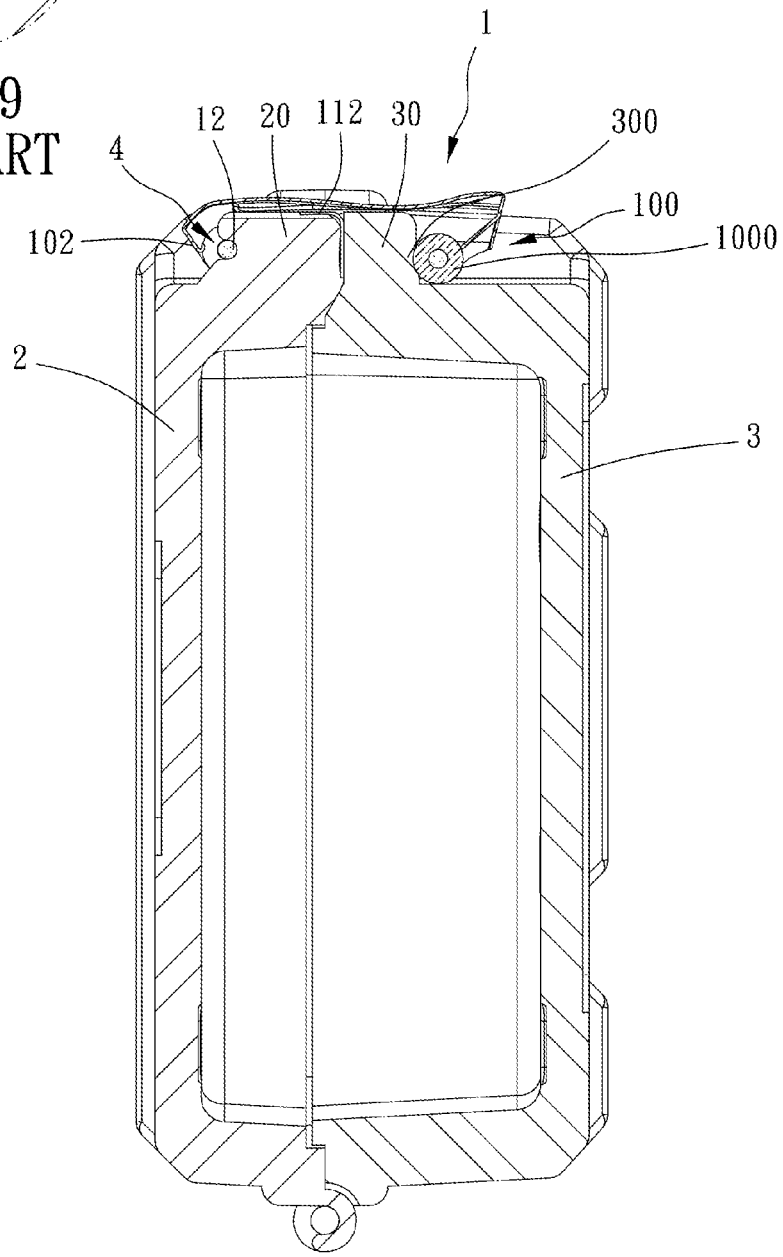
FIGS. 5 to 7 are cross-sectional drawings showing the preferred embodiment of the present invention in use.
Figure 6:
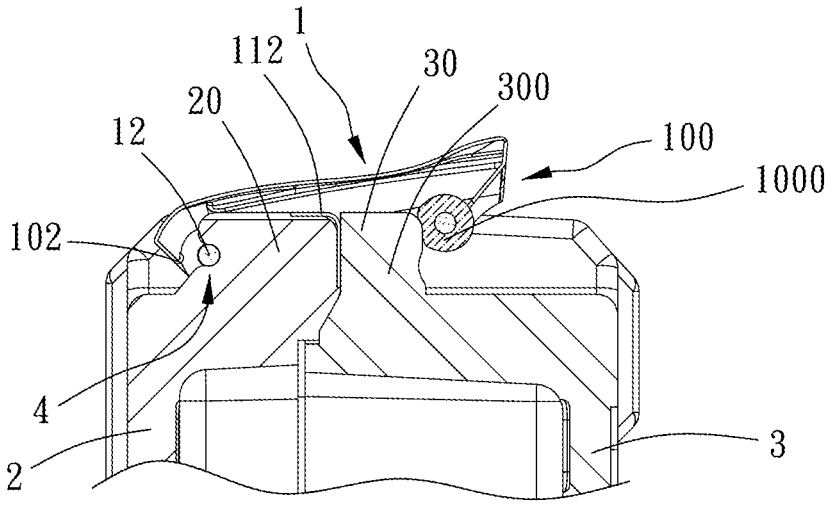
Figure 7:
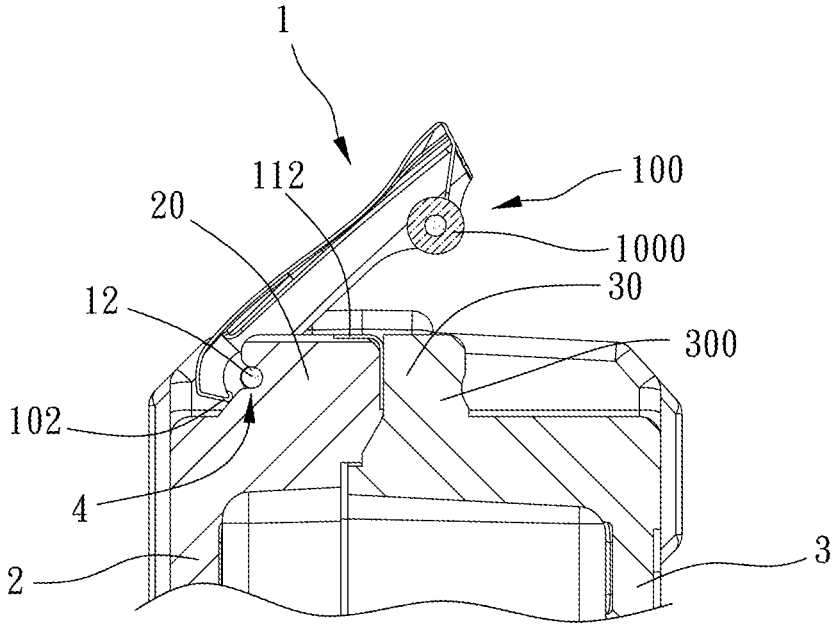
Figure 8:
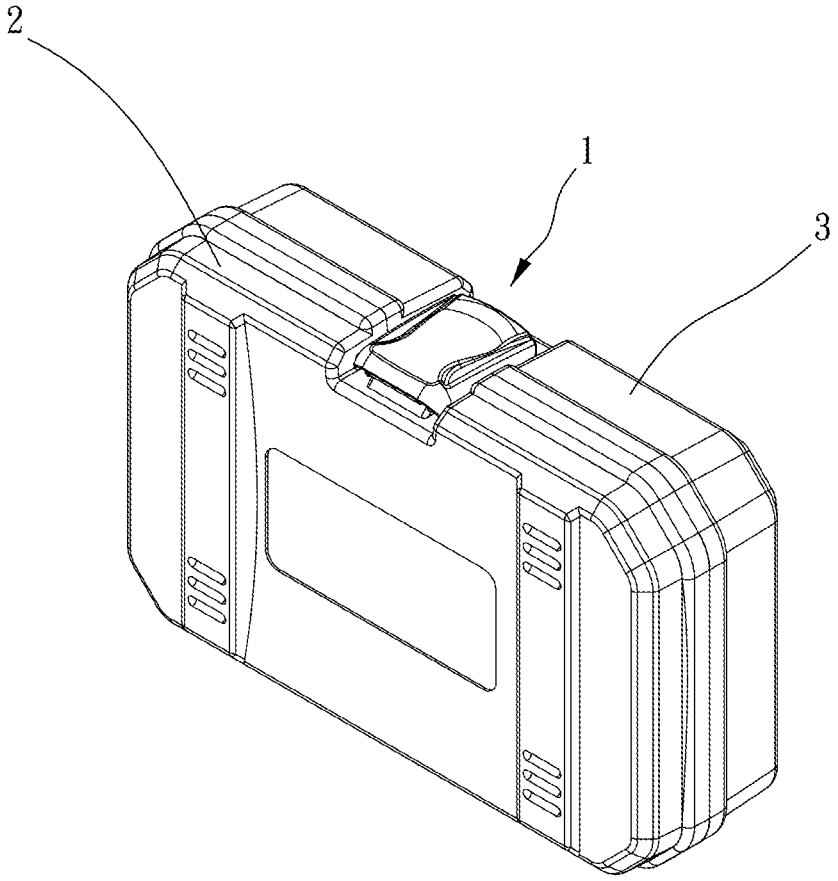
FIG. 8 is a perspective drawing of the preferred embodiment of the present invention in use.

Please refer to FIGS. 5 to 7. In this embodiment, the engaging portion 100 includes a flexible roller 1000 which is deformably engageable with the clasping base 30, so the engaging member 10 is not easily abraded when the engaging member 10 is opened and closed. The clasping base 30 includes a clasping portion 300, so when the engaging member 10 is closed, the engaging portion 100 is buckleable with the clasping portion 300. Specifically, the clasping portion 300 is a curved slot, and the clasping portion 300 can be in other shapes to be engageable with the flexible roller 1000. More specifically, the engaging member 10 has an abutting portion 102, and the abutting portion 102 is abuttable by the first cover 2 to restrict a rotation range of the engaging member 10 (as shown in FIG. 7). Furthermore, the abutting portion 102 is a hook structure extending from the engaging member 10, and the first cover 2 has a rotation space which substantially corresponds to the abutting portion 102 for rotation of the abutting portion 102. In addition, the engaging member 10 may be formed with a position-restricting portion 103 (as shown in FIG. 4), and the position-restricting portion 103 is abuttable against the flexible roller 1000 to restrict an axial movement of the flexible roller 1000. Specifically, the position-restricting portion 103 includes two position-restricting protrusions, and the two position-restricting protrusions are disposed on two sides of the flexible roller 100 to restrict the axial movement of the flexible roller 1000. In this embodiment, the two position-restricting protrusions are connected with the engaging member 10 via a slanted board; therefore, when the engaging member 10 is opened, it is not uncomfortable for the user to toggle the slanted board.

Figure 10:
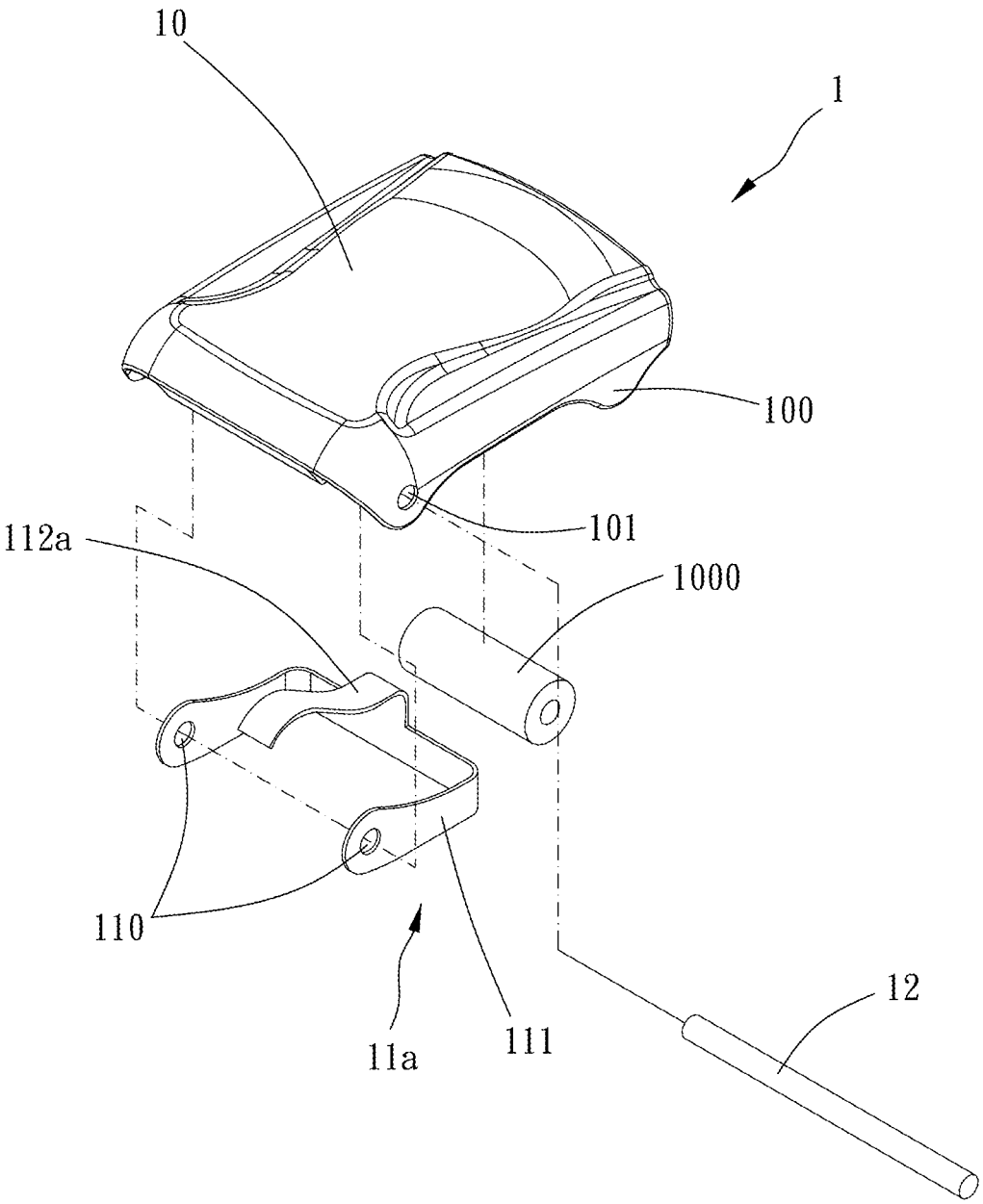
FIG. 10 is a breakdown drawing of another preferred embodiment of the present invention.
Figure 11:
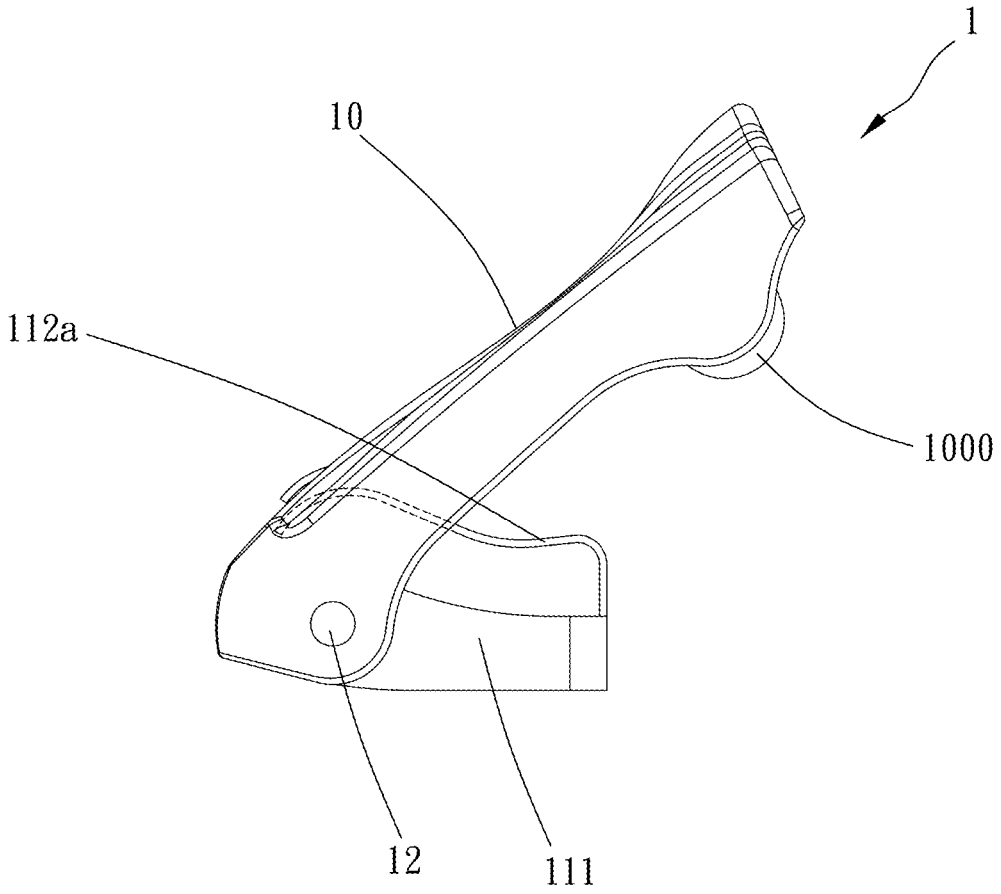
FIG. 11 is a drawing showing another preferred embodiment of the present invention.

Please refer to FIGS. 10 to 11 for a positioning member 11*a* of another preferred embodiment. Compared with the embodiment as shown in FIGS. 1 to 8, the positioning member 11*a* changes the toggling portion into an elastic portion 112*a*; therefore, when the engaging member 10 is opened, the elastic portion 112*a* abuts against the engaging member 10 to keep the engaging member 10 open in an angle.

Given the above, the anti-off structure of a tool box has the positioning member to prevent the engaging member from falling off from the tool box and is easy to be assembled. In addition, the engaging member is not easily damaged after being assembled to the pivoting base many times.

While we have shown and described various embodiments in accordance with the present invention, it should be clear to those skilled in the art that further embodiments may be made without departing from the scope of the present invention.

What is claimed is:

1. An anti-off structure of a tool box, the tool box including a first cover and a second cover pivoted with and correspondingly coverable on each other on a side thereof, the first cover having a pivoting base, the second cover having a clasping base, the anti-off structure including:

an engaging member, including an engaging portion, an end of the engaging member pivoted to the pivoting base via a pivoting connection mechanism; the engaging portion being buckleable with the clasping base when the first and second covers cover on each other;

a positioning member, connected with the pivoting connection mechanism and the pivoting base to positionably restrict the pivoting connection mechanism wherein the engaging portion includes a flexible roller which is deformably engageable with the clasping base.

2. The anti-off structure of a tool box of claim 1, wherein the pivoting connection mechanism includes a first pivoting connection portion provided on the engaging member, a second pivoting connection portion provided on the positioning member, a pivoted portion provided on the pivoting base and a pivoting rod, the pivoting rod is pivoted to the first and second pivoting connection portions and the pivoted portion so that the engaging member and the positioning member are assembled to the pivoting base.

3. The anti-off structure of a tool box of claim 2, wherein at least one of the first and second pivoting connection portions is a through hole.

4. The anti-off structure of a tool box of claim 1, wherein the clasping base includes a clasping portion, and the clasping portion is a curved slot.

5. The anti-off structure of a tool box of claim 1, wherein the engaging member has a position-restricting portion, and the flexible roller is abuttable by the position-restricting portion to restrict an axial movement of the flexible roller.

6. An anti-off structure of a tool box, the tool box including a first cover and a second cover pivoted with and correspondingly coverable on each other on a side thereof, the first cover having a pivoting base, the second cover having a clasping base, the anti-off structure including:

an engaging member, including an engaging portion, an end of the engaging member pivoted to the pivoting base via a pivoting connection mechanism; the engaging portion being buckleable with the clasping base when the first and second covers cover on each other;

a positioning member, connected with the pivoting connection mechanism and the pivoting base to positionably restrict the pivoting connection mechanism;

wherein the pivoting base has a positioning slot provided for the positioning member to be restrictedly disposed therein; wherein the positioning slot includes a circumferential slot portion and a top slot portion, the positioning member includes a C-shaped main body and an L-shaped toggling portion, the C-shaped main body is restrictedly disposed in the circumferential slot portion, and the toggling portion extends from the C-shaped main body to be restrictedly disposed in the top slot portion.

7. An anti-off structure of a tool box, the tool box including a first cover and a second cover pivoted with and correspondingly coverable on each other on a side thereof, the first cover having a pivoting base, the second cover having a clasping base, the anti-off structure including:

an engaging member, including an engaging portion, an end of the engaging member pivoted to the pivoting base via a pivoting connection mechanism; the engaging portion being covers cover on each other;

a positioning member, connected with the pivoting connection mechanism and the pivoting base to positionably restrict the pivoting connection mechanism; wherein the pivoting base has a positioning slot provided for the positioning member to be restrictedly disposed therein;

wherein the positioning slot includes a circumferential slot portion and a top slot portion, the positioning member includes a C-shaped main body and an elastic portion, the C-shaped main body is restrictedly disposed in the circumferential slot portion, and the elastic portion extends from the C-shaped main body to be restrictedly disposed in the top slot portion and to abut against the engaging member.

* * * * *